United States Patent [19]

Doucette et al.

[11] 4,210,199

[45] Jul. 1, 1980

[54] HEAT EXCHANGE SYSTEM

[75] Inventors: Edward I. Doucette, York; Samuel P. Shelley, Shrewsbury, both of Pa.

[73] Assignee: Doucette Industries, Inc., York, Pa.

[21] Appl. No.: 915,308

[22] Filed: Jun. 14, 1978

[51] Int. Cl.[2] ..... F28F 9/26

[52] U.S. Cl. ..... 165/70; 165/143; 285/13

[58] Field of Search ..... 165/140–143, 165/70; 285/13

[56] References Cited

U.S. PATENT DOCUMENTS

| | | | |
|---|---|---|---|
| 2,365,515 | 12/1944 | Baudry | 165/70 |
| 2,545,280 | 3/1951 | Hullmeyer et al. | 165/143 |
| 2,730,337 | 1/1956 | Roswell | 165/70 X |

FOREIGN PATENT DOCUMENTS

| | | | |
|---|---|---|---|
| 728592 | 4/1955 | United Kingdom | 165/70 |
| 730284 | 5/1955 | United Kingdom | 165/70 |

*Primary Examiner*—Samuel Scott

*Assistant Examiner*—Theophil W. Streule, Jr.

*Attorney, Agent, or Firm*—C. Hercus Just

[57] ABSTRACT

A heat exchange system having a first tube system of tubes which are interconnected to conduct a first fluid and a second tube system comprising tubes surrounding the tubes of the first system to conduct a second fluid in heat exchange relationship with the first fluid, the preferred embodiment of the tubes of the first system being double walled and shaped to provide a passage for the escape of any fluid leaking from an opening occurring in either the inner or outer wall of the tubes of the first system. In the preferred embodiment, the double walled tubes are concentric tubes spaced radially to permit formation of a spiral groove on one tube, preferably the outermost, which provides a spiral path between said tubes which is open to atmosphere at the ends. Detachable return elbows interconnect adjacent ends of the innermost tubes to effect a continuous path for the fluid therein and the elbows at one end are removable to facilitate cleaning said tubes.

6 Claims, 4 Drawing Figures

FLUID NO. 1 OUT
FLUID NO. 2 IN
10
12
14
16
18
20
22
24
26
28
42
52
56
58

HEAT EXCHANGE SYSTEM

BACKGROUND OF THE INVENTION

This invention relates to a heat exchange system and one particular version thereof comprises a de-superheater system applicable to the reclaimation of waste heat given off by refrigerant gases employed in refrigerating systems, such de-superheater reclaiming a useful portion, if not substantially the entire amount of the heat in such refrigerating gases, for useful purposes, rather than discharge it to atmosphere and waste the same. One specific use for the de-superheater is in regard to heating potable water either for domestic or industrial purposes by such utilization of waste heat given off by said refrigerant gases. In view of the fact, however, that most refrigerant gases and oils are non-potable, it is a principal aim and objective of the present invention to minimize the occurrence of any contamination between such gases and liquids to render the use of the system safe to achieve the objectives of utilization of waste heat. Such safety is achieved by providing discharge passage means for any leakage of either such gases or liquids, for example, to conduct the same from the system to atmosphere, details of which are set forth hereinafter.

Various types of heat exchange systems have been devised heretofore in which tubular systems have been employed in various ways to effect operable conduct of fluids of different types, or at different temperatures, through adjacent wall means comprising separate conduits for such fluids, the arrangement being such as to effect heat transfer between the respective fluids, whether gaseous or liquid or mixtures thereof. To effect greater efficiencies, certain types of spiral paths have been provided in the structures developed heretofore, typical examples of which are shown in the following U.S. Pat. Nos.:

1,057,505, Smith, Apr. 1, 1913;
2,066,480, McKerrall, Jan. 5, 1937;
2,730,337, Roswell, Jan. 10, 1956;
3,468,371, Menze, Sept. 23, 1969;
3,730,229, D'Onofrio, May 1, 1973.

None of the foregoing patents utilize the spiral paths illustrated therein for purposes of conducting leaking fluid from the system or provide visible evidence of a leak of the fluids respectively carried in the cooperating conduits by which heat exchange is effected, and also prevent contamination thereof.

The prior art also discloses the use of return bends in the form of elbows by which pluralities of parallel tubes, for example, are connected at the ends of adjacent tubes to provide a continuous path for a specific fluid, for example, the ends of which path respectively comprise inlet and outlet means for said fluid, the elbows being connected to headers which are detachable in a manner to remove the elbows from the conduits and one specific example thereof is shown in U.S. Pat. No. 3,527,290, to Lossing, dated Sept. 8, 1970.

The problem of detecting leakage in heat exchange systems also has engaged the attention of prior inventors as follows: U.S. Pat. No. 2,893,701 to Bell, dated July 7, 1959, in which leak-detecting and indicating instruments are in communication with chambers in the system, said instruments reacting to the leakage of either fluid in the system in a manner to indicate that a leakage has occurred.

U.S. Pat. No. 3,830,290 to Thamasett et al, dated Aug. 20, 1974, discloses leakage indicating means comprising two concentric tubes between which leakage indicating medium can penetrate pyramid-shaped spacers between concentric tubes, one of the spaces being filled with gas which serves as a leakage detector.

U.S. Pat. No. 4,054,981 to Bridgegum, dated Oct. 25, 1977, pertains to a unit for heating water in a storage tank through the medium of solar heated fluid. The system essentially comprises an inner cylindrical tank for storage water, and annular walls surrounding said inner storage tank and adapted to contain the heating fluid energized by solar energy and a narrow annular space being formed between the inner tank and the annular walls which define an annular enclosure for said heating fluid, said narrow space having openings at opposite ends to permit the discharge of any fluid leaking either from the central tank or the annular surrounding enclosure of heating fluid, whereby there is no suggestion of countermovement or movement in the same direction between the several fluids incident to effecting heat exchange therebetween.

SUMMARY OF THE INVENTION

As referred to hereinabove, one of the principal objectives of the present invention is to provide a heat exchange system in which, for example, a hazardous type of fluid, either gas or liquid, may be flowed in one tube system, preferably in counter direction for efficiency, relative to a second fluid, such as potable water, which is carried by a second tube system enclosed within the first tube system and the minimizing or elimination of any danger of intercommunication between the two fluids, such as might occur by one or more openings developed in the inner tubular system being effected by providing a passageway for any such leaking fluid which terminates exteriorly of the system for discharge of the leaking fluid to atmosphere.

It is another object of the invention to provide such passage for any leaking fluid by utilizing preferably a double wall conduit of which at least one wall is shaped to provide said escape passage means which has an axial directional component of flow and also having at least one exit end.

It is a further object of the invention to provide said system in the form of a first tube system comprising substantially coaxial tubes in close relationship to form a double wall conduit, means connecting the ends of one of said coaxial tubes of said system to form a path having opposite ends for inlet and outlet of a first fluid, a second tube system including tubes of larger diameter surrounding the tubes of the first tube system and thereby form a conduit for a second fluid in heat exchange relationship with said first fluid, additional means connecting tubes of said second tube system to form a path having opposite ends for inlet and outlet of said second fluid, the coaxial double wall tubes of said first tube system extending through said additional connecting means in sealed relationship thereto, and all exit ends of said escape passage means extending outward to atmosphere from said additional connecting means for the tubes of said second tube system, thereby to maintain the fluids of said systems free from contaminating each other in the event of a leak occurring in either of the tubes of the coaxial tubes of said first tube system.

Still another object of the invention is to form the double wall conduits of the first tube system from coaxial tubes respectively having different diameters to provide an annular space therebetween, whereby at least one of said tubes is deformed to provide said escape passage means comprising at least part of the space between said pairs of tubes.

It is another object of the present invention ancillary to the immediately foregoing object to deform the outermost of said pairs of tubes of different diameters of the first system by forming therein a spiral groove, preferably to dispose the bottom of said groove in contact with the outer surface of the innermost tube and thereby form a spiral path between said coaxial tube which comprises the escape path for any leaking fluid, said spiral being of suitable pitch to render efficient the axial component of the spiral movement of such escaping fluid to atmosphere at the end of the space between said coaxial tubes.

A still further object of the invention is to interconnect similar ends of the innermost tubes of said double wall conduit by means of returns in the form of U-shaped elbows, said elbows for similar ends of said innermost tubes being mounted commonly in a header plate and a complementary header plate being connected to said ends of the innermost tubes for reception of a fluid-tight gasket between said header plates when connected, whereby said elbows on the first header plate may be readily disconnected with the header plate therefor from the ends of said tubes to permit ready access thereto for cleaning purposes or other similar operations requiring the ends of said tubes to be exposed.

Still another object of the invention is to provide tubes of the second tube system which are shorter than those of the first tube system, whereby preferably opposite ends of the first tube system extend beyond the connecting means for the ends of the second tube system, whereby the outer ends of the outermost tubes of the double wall conduits of the first tube system are also disposed outwardly from said connecting means for the second tube system and thereby dispose the ends of the escape passage means for any leaking fluid directly in communication with the atmosphere, said ends of the aforementioned spiral escape passage means terminating a short distance from the ends of the outermost tube of said double wall conduit, thereby facilitating the sealing of said outer ends of said outer tubes of said double wall conduits with the connecting means which extend between and are connected to the tubes of said second tube system.

Details of the foregoing objects and of the invention, as well as other objects thereof, are set forth in the following specification and illustrated in the accompanying drawings comprising a part thereof.

DETAILED DESCRIPTION

Figure 1:
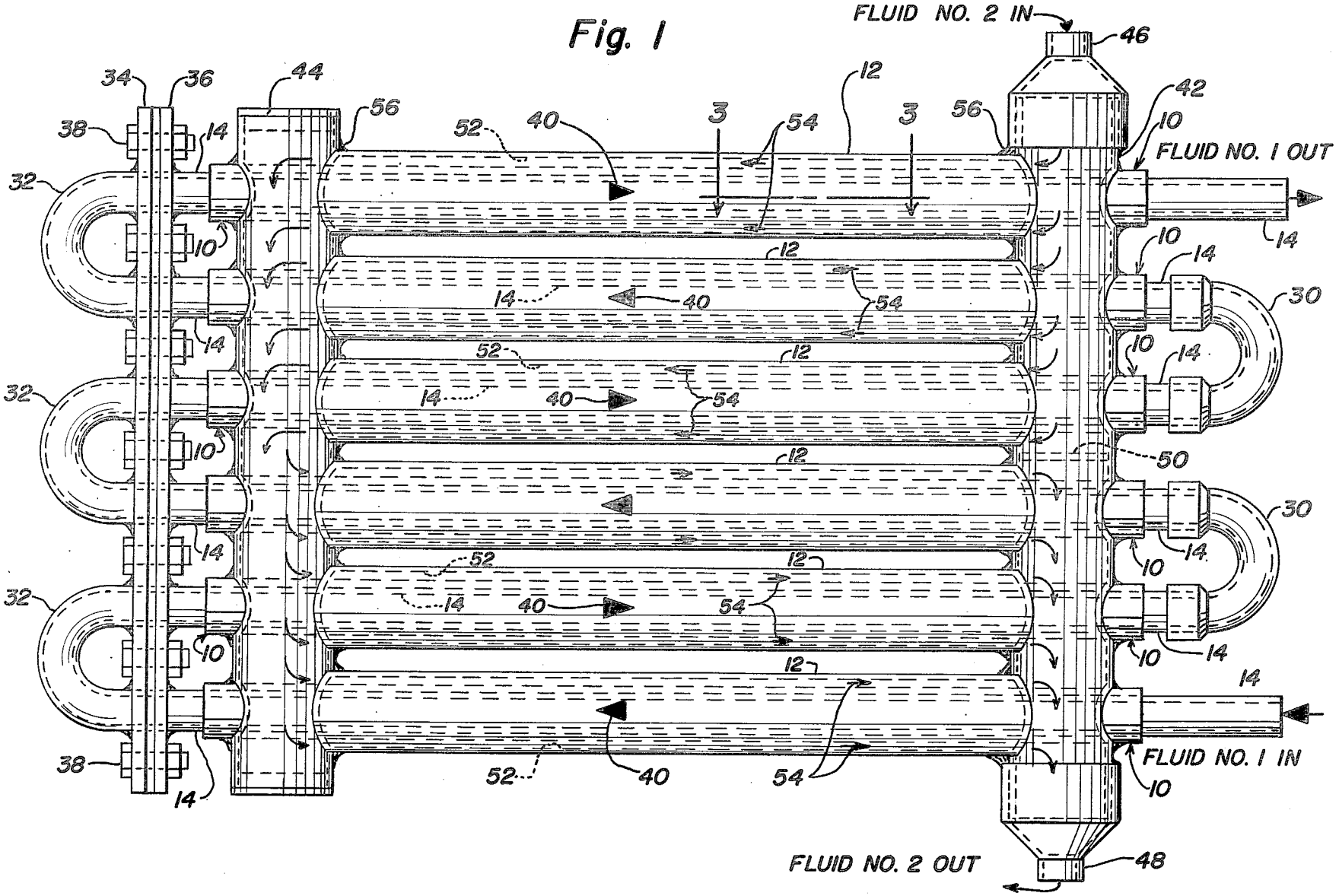
FIG. 1 is a plan view of an exemplary heat exchange system embodying the principles of the present invention.
Figure 2:
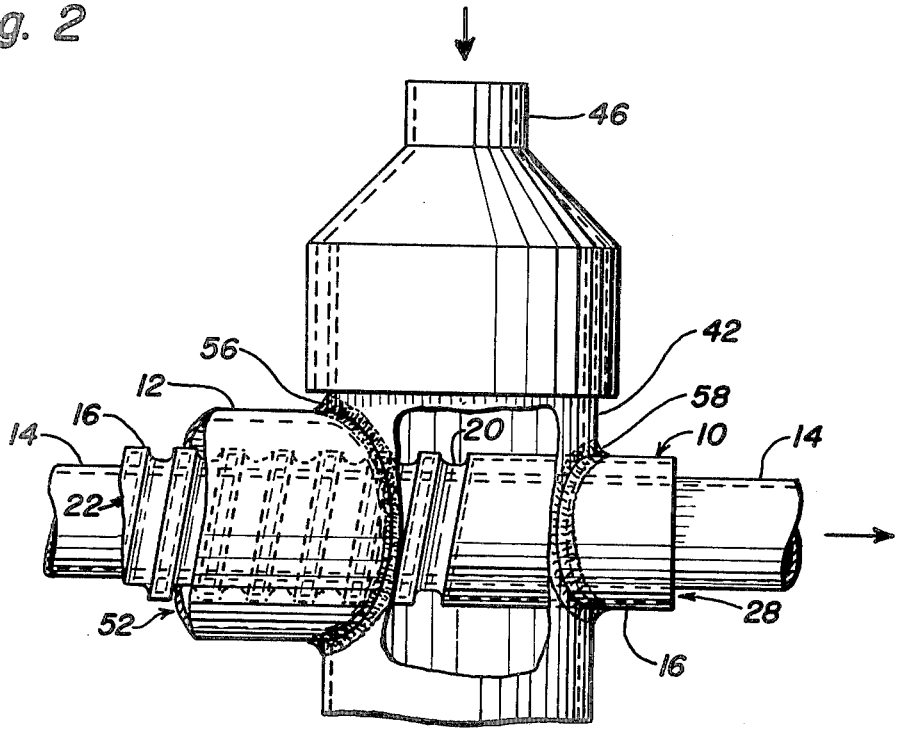
FIG. 2 is a fragmentary detail of the system shown in FIG. 1, as seen in the upper right-hand corner thereof, part of the view being broken away to show details of the interior thereof.

As indicated above, and referring to FIG. 1, the specific structure selected for illustrating the principles of the present invention comprises a heat exchange system which is highly effective to serve as a de-superheater by which most, if not substantially the entire amount, of the heat normally comprising waste energy given off by refrigerant gases of refrigerating systems can be utilized as a source of heat which can be converted to useful purposes, such as heating potable water, either for domestic or industrial purposes. While specific reference is made to this type of utilization of the present system, it is to be understood that the principles thereof are applicable to various other heat exchange systems and particularly those in which heat exchange is effected between two different fluids, either gaseous or liquid, one of which, for example, may be of a toxic or poisonous nature, and the other intended for purposes which cannot tolerate such properties of the first-mentioned fluid.

After substantial periods of use in which various coaxial tubes having cylindrical spaces therebetween respectively conduct either different fluids or fluids at different temperatures respectively between the inner tube and said cylindrical space, it is known that holes or other forms of openings, such as cracks and the like, develop, for example, within the inner tube and it is difficult to detect such leakage until after contamination of one fluid or the other has occurred and possible damage has resulted from the consumption or utilization of the contaminated fluid. Although certain monitoring or detecting arrangements have been utilized in attempting to detect if leakage has occurred in certain heat exchange systems as illustrated in several of the patents referred to hereinabove, no means have heretofore been developed by which, in a heat exchange system including a plurality of tubular systems interconnected at the ends thereof for an extended passage affording countercurrent movement of different fluids therein for heat exchange purposes, for example, any contaminated fluid resulting from leakage between the coaxial tubes of the system is automatically conducted safely from the system to atmosphere, where such leakage may be detected before contamination of one fluid with the other has occurred and such escape of any leaking fluid is effected by the construction of the present invention, details of which are as follows:

For purposes of describing the present invention, especially to simplify the same, reference to the fluids which may be utilized in the heat exchanging capabilities of said system will be designated hereinafter as a first fluid and a second fluid. As indicated above, these fluids may be either liquid or gaseous and mixtures or solutions thereof, or similar fluids may be respectively circulated through the heat exchange tube arrangement of the system but in regard to which different temperatures occur in the respective fluids. Similarly, the system essentially comprises a first tube system and a second tube system, means for connecting the tubes of the first tube system to form an extensive passageway, the opposite ends of which comprise inlet and outlet means for the first fluid, while the second tube system comprises tubes which are of a larger diameter but shorter than the tubes of the first system and respectively substantially coaxially surround the same, additional means connecting the ends of the tubes of the second tube system in order to form a substantially continuous passage for the second fluid between the inlet and outlet ends of said passage.

Referring to FIG. 1, a plurality of preferably parallel tubes 10, which actually comprise double wall conduits including inner and secondary wall means, are of smaller diameter and longer than the tubes 12 comprising the second tube system, said tubes surrounding at least the major portions of the tubes 10 of the first system, and the opposite ends of the tubes 10 each extending beyond corresponding ends of the tubes 12. As indicated, the tubes 10 are double wall conduits as will be clearly seen especially by referring to FIGS. 3 and 4, in which, at least in the preferred embodiment, the innermost tube 14 preferably is substantially cylindrical, while the secondary tubes 16 of the double wall conduits 10 are cylindrical, preferably only at the outer ends thereof as shown in FIG. 4. Intermediately between the cylindrical outer ends of the outermost tube 16, the same is provided with a spiral groove 18, which is produced by roll-forming or any other equivalent operation to impress said groove into the tube 16 beyond the elastic limit of the material of tube 16 and preferably dispose the bottoms 20 of said groove into firm physical contact with the outer surface of the inner tube 14 while said tubes are coaxially assembled to increase the thermal conductivity between the fluids respectively passing through the fluids in tubes 12 of the second system and tubes 10 of the first system, but such contact not comprising a cold weld.

The spiral grooves 18 form a spiral escape space 22 which surrounds the innermost tube 14 of the double wall conduits 10, the space terminating in cylindrical openings at the opposite ends for purposes of safely and efficiently discharging to atmosphere any leakage of fluids, for example, of the first system, such as through the exemplary hole 24 in the innermost tube 14, as shown in FIG. 4, or in the event an exemplary hole 26, see FIG. 4, should occur in the outermost tube 16 of the double wall conduit 10, the fluid from the second system within tube 12 will escape into the spiral escape space 22 and thereby be conducted to one or the other ends of the outermost tube 16 where discharge occurs through the space 28, which preferably is annular, as shown in FIG. 4, and extends entirely around the innermost tube 14.

Figure 3:
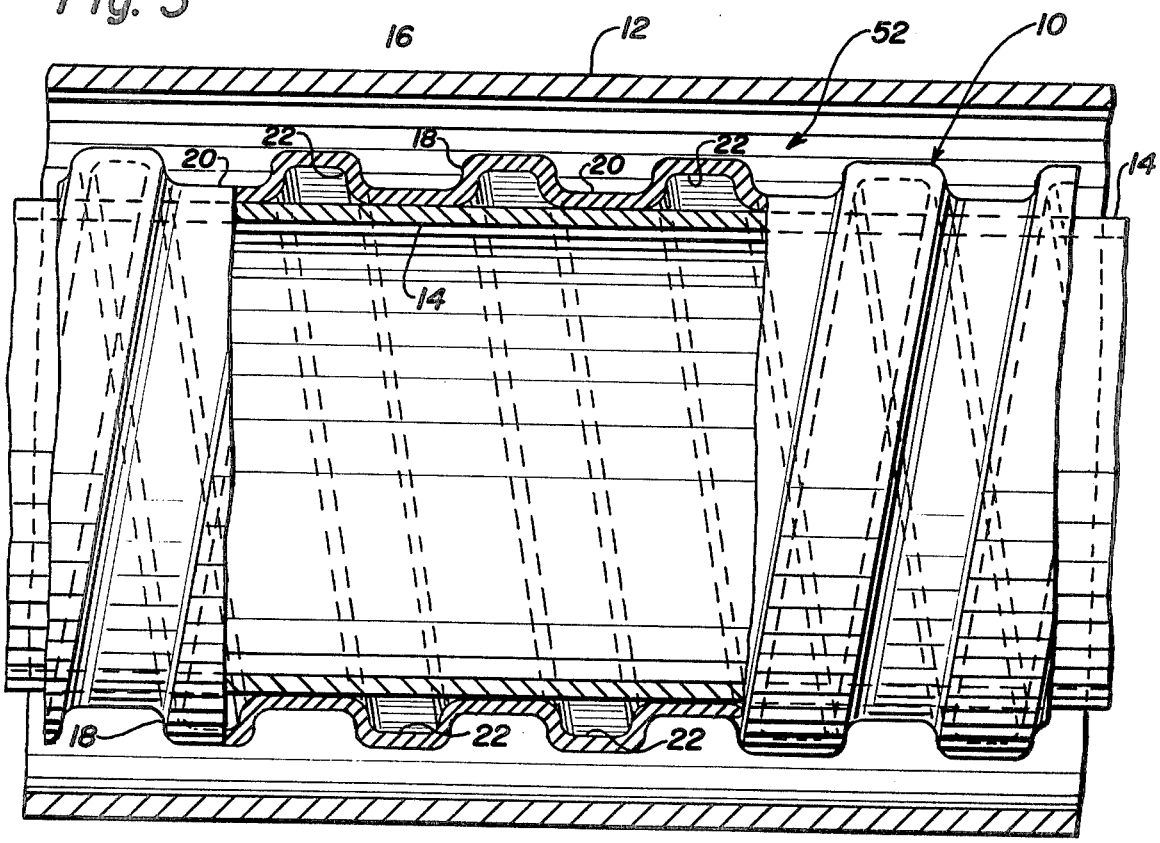
FIG. 3 is a section of one of the composite conduits of the system shown in FIG. 1, partly broken away in vertical cross-section as seen generally on the line 3—3 of FIG. 1, enlarged.
Figure 4:
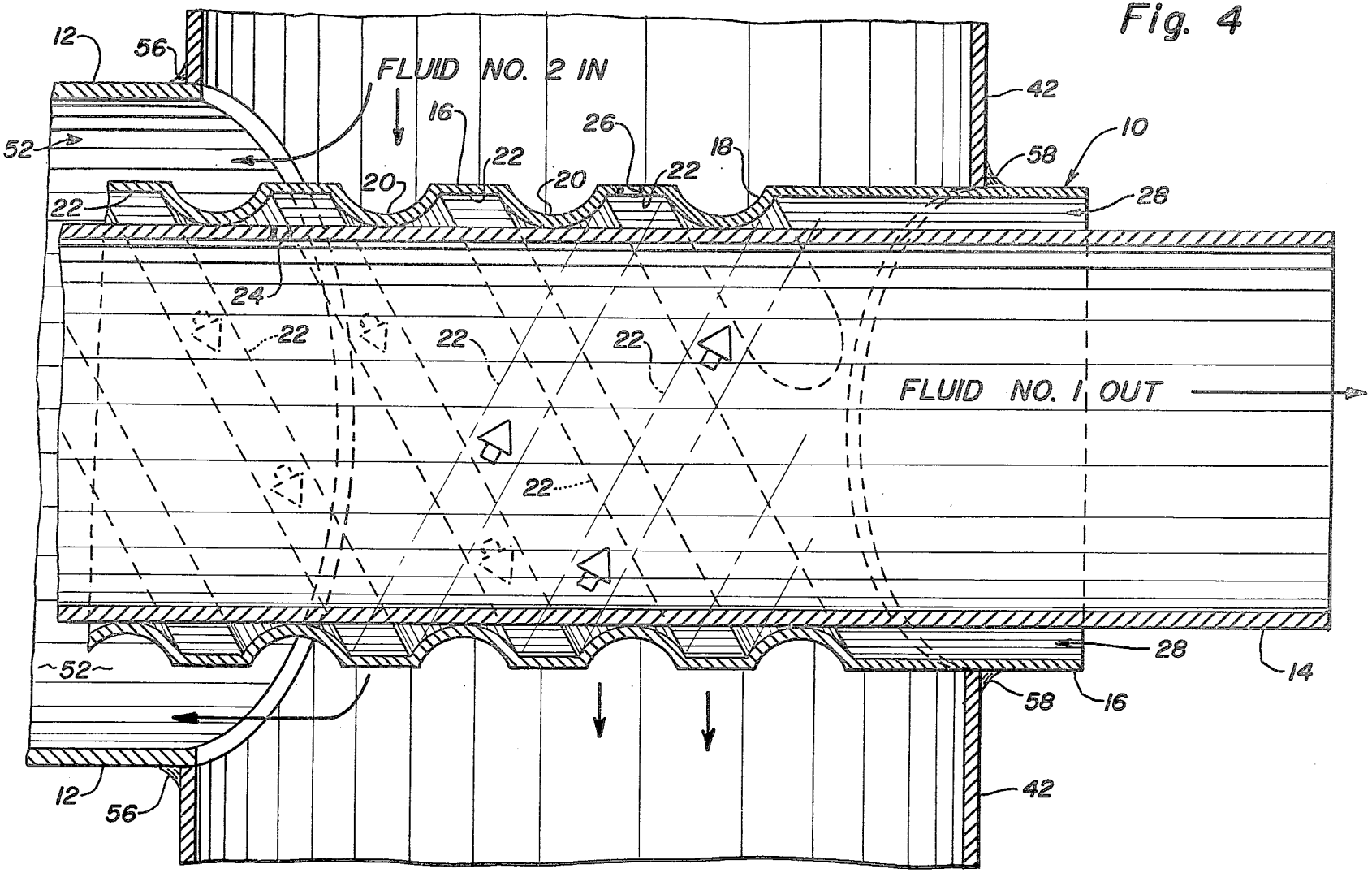
FIG. 4 is a vertical cross-section of a fragmentary portion of that part of the system illustrated in FIG. 2 and showing in further enlarged manner, the escape passage for leaking fluids in relation to the adjacent parts of the system.

For purposes of rendering escape of any leaking fluid as efficient as possible, it is proposed that the pitch of the groove 18 be of the multiple type, such as a double pitch, as shown in FIG. 4, as distinguished from the single pitch of the grooves 18 shown in FIG. 3. By providing a double pitch for such groove, or even a higher multiple, such as 3, the axial component of the spiral path of movement of the escaping fluid will be increased so as not only to enhance such passage, but also to minimize any accumulation of such escaping fluid within the spiral space 22.

Similar ends of adjacent innermost tubes 14 of the double wall conduits 10 are interconnected by return members 30 comprising elbows or the like, the elbows at one end of the system shown in FIG. 1 being directly connected to the outer ends of the innermost tubes 14, while at the left-hand end of the system shown in FIG. 1, additional return members or elbows 32 are connected at the opposite ends thereof to one of a pair of similar header plates 34 and 36, the header plate 34 having holes therein coinciding with the holes in the ends of the return members 32, the pattern of said holes corresponding to the cross-sectional pattern of the ends of the innermost tubes 14 of the first system of tubes and the ends of said innermost tubes 14 extending through corresponding holes in the header plate 36, the header plates being detachably connected by means of appropriate bolts 38. By such arrangement, and referring to FIG. 1, it will be seen that fluid No. 1 may be introduced through the end of the innermost tube 14 at the right-hand corner of FIG. 1, and will travel sinuously successively through all of the innermost tubes 14 of the first system, as indicated by the heavier directional arrows 40, until fluid No. 1 is discharged from the system through the right-hand end of the innermost tube 14 appearing in the upper right-hand corner of FIG. 1.

As is obvious from the drawing, especially FIG. 1, as indicated by the various directional arrows, the purpose of tubes 12 of the second system is to conduct fluid No. 2 in heat exchanging relationship with fluid No. 1 in the first system. To accomplish this, the opposite ends of the tubes 12, which are shorter than the double wall conduit tubes 10, are interconnected by transversely extending additional connecting means 42 and 44. Connecting means 42 has an inlet 46 for fluid No. 2, and the lower end thereof has an outlet 48 for fluid No. 2, as clearly shown in said figure. In order to prevent direct axial movement of fluid No. 2 within the connecting means 42, baffle member 50 is inserted therein and, depending upon the number of tubes to be included in the heat exchange system of the present invention, a plurality of such baffles may be required, as necessary, to control flow and fluid velocity in either of the connecting means 42 or 44, or both. Connecting means 42 and 44 function as manifold means and the baffle means are such that they insure effective passage of fluid No. 2 through the cylindrical space 52 between the tubes 12 and the outermost tubes 16 of the double wall conduit tubes 10, preferably in the opposite direction to that of the passage of fluid No. 1 in the double wall conduit tubes 10 of the first system, the passage of fluid No. 2 therethrough being indicated in exemplary manner by the small directional arrows 54, shown in FIG. 1.

The opposite ends of the tubes 12 of the second system are effectively connected in fluid-tight relationship with respect to the connecting means 42 and 44 by appropriate means such as brazing or silver soldering 56 and correspondingly, the outer ends of the outermost tubes 16 of the double wall conduits 10 of the first system likewise are effectively sealed in fluid-tight relationship with respect to the additional connecting means 42 through which the tubes 16 pass by additional brazing or silver soldering 58.

In order to adapt the heat exchange system embodying the principles of the present invention to a substantial range of heat exchange operations, in addition to serving as de-superheaters, for example, it is to be understood that particularly the inner and outer tubes 14 and 16 of the double wall conduits 10 may be fabricated from steel, copper, cupronickel or stainless steel of appropriate compositions, particularly those which are capable of having the spiral grooves 18 formed in the outermost tube 16 thereof. Further, preferably no low temperature alloy should be used in any of the components of the system. It also will be seen that all joints are of an external nature and are easily accessible, should repair be necessary.

Although the foregoing description has specifically described and illustrated a heat exchange system in which double wall conduits of the first tube system are disposed within larger diameter tubes of a second tube system, it is to be understood that more than one of such double wall tubes may be disposed within a single tube of suitable diameter or shape of the second tube system to accommodate the same and include required revised fittings and connections to assemble the same, within the spirit of the invention. Further, two or more of the tube system assemblies or units may be connected in parallel to increase the capacity thereof when required or desired.

From the foregoing, it will be seen that the present invention provides a heat exchange system capable of use in a wide range of applications where heat exchange is required and it is particularly effective in use where contamination between the respective fluids handled by the several tube systems cannot tolerate contamination therebetween. If leakage should occur incident to use from any cause by the formation of openings in either of the inner or outermost tubes of the double wall conduits of the first sytem, the escape passage provided in the form of a preferably spiral passage leading at the opposite ends thereof to atmosphere, will enable the leaking fluid to escape without contaminating the other fluid in the system, and such leakage also will serve as indication that a rupture in the tubes of either the first or second tube system has occurred, and thereby permit discontinuance of the use of the system and repair thereof, as required.

In addition, ready removability of the return members connecting one end of the innermost tubes of the first system renders said tubes readily accessible for cleaning with minimum difficulty.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

We claim:

1. A heat exchange system comprising in combination, (a) a first tube system comprising a plurality of substantially parallel similar tubes, and (b) return members connecting similar ends of adjacent tubes to form a first fluid passage having inlet and outlet means adjacent opposite ends thereof, (c) a second tube system comprising a plurality of similar tubes of larger diameter than the tubes of said first system and respectively surrounding at least portions of the same between opposite ends thereof, and (d) additional connecting means positioned inwardly from the outer ends of the tubes of said first tube system and connected between similar ends of adjacent tubes of said second tube system for intercommunication therebetween to form a second fluid passage having fluid inlet and outlet means surrounding the tubes of said first tube system;

(e) the improvement comprising leak-conducting means substantially coaxial and coextensive with said tubes of said first tube system and comprising supplemental tubular wall means surrounding said tubes of the first system in spaced relationship thereto and having outer ends extending beyond the ends of the tubes of said second tube system, said supplemental tubular wall means having a continuous spiral groove roll formed therein to compress the bottom of said groove into firm thermal contact with said tubes of the first system without substantial decrease of the wall thickness of said supplemental tubular wall means to provide a spiral passage around the tubes of said first tube system for discharge of leaking fluid to atmosphere at opposite ends of said leak-conducting means to prevent contamination of fluids respectively in said first and second tube systems in the event of leakage openings occurring in any of the tubes on the interior of said second tube system.

2. The system according to claim 1 in which said supplemental tubular wall means are tubes deformed by rolling compression to provide said substantially spiral passage surrounding the tubes of said first tube system and having an axial directional component.

3. The system according to claim 2 in which said spiral passage comprises a plurality of spiral grooves in multiple pitch arrangement in said supplemental tubes and in which the bottom of said grooves are in firm metallic contact with the tubes of said first tube system and thereby provide a plurality of spiral escape passages of greater pitch than afforded by a groove of single pitch.

4. The heat exchange system according to claim 1 in which said spiral groove in said supplemental tubular wall means terminates short of the ends of said secondary tubular wall means, thereby to form a cylindrical discharge passage at the opposite ends of said secondary tubular wall means.

5. A heat exchange system comprising in combination, (a) a first tube system comprising a plurality of substantially coaxial parallel pairs of tubes in close relationship forming double wall conduits to conduct a first fluid, (b) the outer one of said tubes of said double wall conduit being deformed by roll-forming to provide a spiral groove having a bottom surface in firm contact with the inner one of said pairs of tubes to form a spiral escape passage means having an axial directional component of flow and also having at least one exit end, (c) a second tube system including tubes of larger diameter than said first tube system surrounding the tubes of said first tube system substantially coaxially to form a conduit system for a second fluid in heat exchange relationship with said first fluid, (d) additional tube means extending transversely between and connecting the ends of the tubes of said second tube system to form a counter-current path having opposite ends for inlet and outlet of said second fluid, (e) the coaxial double wall tubes of said first tube system extending transversely through said additional tube means in sealed relationship thereto, (f) return means connecting similar outer ends to the inner one of said coaxial tubes of said first tube system, (g) a header plate through which similar opposite outer ends of the inner tubes of said first tube system extend and to which said ends are connected flush with the outer surface of said plate, (h) another header plate complementary to said aforementioned header plate and detachably connected thereto and provided with a plurality of return elbows respectively communicating with the ends of successive pairs of said similar opposite outer ends of the inner tubes of said first tube system, thereby forming a continuous path for said first fluid and the detachability of said another header and elbows thereon affording cleaning access to the interiors of the inner tubes of said first tube system, and (i) all exit ends of said spiral escape passage means extending outward to atmosphere beyond said additional tube means connecting the tubes of said second tube system, thereby maintaining the fluids of said systems free from contaminating each other in the event of a leak occurring in either of the tubes of the coaxial tubes of said first tube system.

6. The heat exchange system according to claim 5 further including a baffle in one of said additional transverse tube means intermediately of the ends thereof and operable to effect countercurrent flow of said second fluid in said second tube system.

* * * * *